US009165511B2

(12) United States Patent
Zhang

(10) Patent No.: US 9,165,511 B2
(45) Date of Patent: Oct. 20, 2015

(54) BACKLIGHT DRIVING CIRCUIT, LCD DEVICE, AND DRIVING METHOD

(71) Applicant: SHENZHEN CHINA STAR OPTOELECTRONICS TECHNOLOGY CO., LTD, Shenzhen (CN)

(72) Inventor: Xianming Zhang, Shenzhen (CN)

( * ) Notice: Subject to any disclaimer, the term of this patent is extended or adjusted under 35 U.S.C. 154(b) by 96 days.

(21) Appl. No.: 13/880,021

(22) PCT Filed: Mar. 15, 2013

(86) PCT No.: PCT/CN2013/072737

§ 371 (c)(1),
(2) Date: Apr. 17, 2013

(87) PCT Pub. No.: WO2014/139164

PCT Pub. Date: Sep. 18, 2014

(65) Prior Publication Data

US 2014/0267447 A1 Sep. 18, 2014

(30) Foreign Application Priority Data

Mar. 14, 2013 (CN) ..... 2013 1 0082135

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2330/00* (2013.01)

(58) Field of Classification Search
CPC ..... G09G 2330/00–2330/12
USPC ..... 345/102, 211–213
See application file for complete search history.

(56) References Cited

U.S. PATENT DOCUMENTS

| | | | | |
|---|---|---|---|---|
| 2010/0123701 | A1 | 5/2010 | Yeo | |
| 2010/0289425 | A1 * | 11/2010 | Huang et al. | 315/250 |
| 2011/0080397 | A1 * | 4/2011 | Yamamoto et al. | 345/214 |

FOREIGN PATENT DOCUMENTS

| | | | |
|---|---|---|---|
| CN | 101281734 | A | 10/2008 |
| CN | 101465952 | A | 6/2009 |
| CN | 201365366 | Y | 12/2009 |
| CN | 101630489 | A | 1/2010 |
| CN | 102025282 | A | 4/2011 |
| JP | H07181928 | A | 7/1995 |
| JP | 2005210706 | A | 8/2005 |

OTHER PUBLICATIONS

Tang Yuxi, The International Searching Authority written comments, Apr. 2013, CN.

* cited by examiner

*Primary Examiner* — Sanghyuk Park

(57) ABSTRACT

The present disclosure provides a backlight driving circuit, a liquid crystal display (LCD) device, and a driving method. The backlight driving circuit includes a monitoring device and a conversion device, the conversion device includes a microcontroller (MCU) and a switch module. A control end of the switch module is coupled to the monitoring device, and the monitoring device outputs a monitoring signal to turn on or turn off the switch module. An input end of a power source of the MCU is coupled to a power end of the backlight driving circuit through the switch module.

11 Claims, 3 Drawing Sheets

BACKLIGHT DRIVING CIRCUIT, LCD DEVICE, AND DRIVING METHOD

TECHNICAL FIELD

The present disclosure relates to the field of liquid crystal displays (LCDs), and more particularly to a backlight driving circuit, an LCD device, and a driving method.

BACKGROUND

A backlight module provides a light source to a liquid crystal (LC) panel. As shown in FIG. 1, a control scheme of a backlight driving circuit of the backlight module may use a microcontroller (MCU). Subject to characteristics of the MCU, the MCU first needs a power supply from a power end of the backlight driving circuit, and then receives a monitoring signal output by an external monitoring device. The monitoring signal includes an enable signal controlling a conversion device to turn on or turn off and a dimming signal adjusting a backlight brightness of a liquid crystal display (LCD). If the MCU first receives the monitoring signal, and then is provided with the power supply, the MCU may work abnormally or be damaged. To avoid time sequencing errors when the MCU first is provided with the power supply and then receives the monitoring signal, the MCU needs to maintain power for a long time, which results in the MCU working even in a stand-by state, thus increasing stand-by power, and does not completely avoid the time sequencing errors of the monitoring signal in use of the MCU. If the monitoring signal is input the MCU prior to the power supply, the MCU does not work normally.

SUMMARY

The aim of the present disclosure is to provide a backlight driving circuit, a light crystal display (LCD) device, and a driving method capable of low energy consumption and high reliability.

The aim of the present disclosure is achieved by the following technical scheme.

A backlight driving circuit comprises a monitoring device and a conversion device, where the conversion device comprises a microcontroller (MCU) and a switch module. A control end of the switch module is coupled to the monitoring device, and the monitoring device outputs a monitoring signal to turn on or turn off the switch module. An input end of a power source of the MCU is coupled to a power end of the backlight driving circuit through the switch module.

Furthermore, the backlight driving circuit comprises a peripheral circuit module. The MCU outputs a driving signal that is same as the monitoring signal output by the monitoring device when the switch module turns on. As long as the MCU is in a power-on state, it means that the monitoring signal has been input to the backlight driving circuit, the method that the MCU outputs the driving signal that is same as the monitoring signal output by the monitoring device does not cause time sequence confusion. Additionally, the driving signal is generated by the MCU, the MCU firstly achieves a power supply logically, and then the driving signal that is same as the monitoring signal may be generated, thus avoiding an abnormal problem of the MCU when the monitoring signal is input to the MCU prior to the power supply, and having high reliability. The MCU may be programmed, where a delay time of outputting the driving signal may be controlled through a soft programming method, and the MCU is suitable for different conditions and has high generality.

Furthermore, the monitoring signal comprises an enable signal controlling the conversion device to turn on or turn off. This is a specific monitoring signal.

Furthermore, the monitoring signal comprises a dimming signal adjusting a backlight brightness of the LCD. This is a specific monitoring signal.

Furthermore, the switch module comprises a first resistor, a controllable switch, and a second resistor that are successively connected in series between the power end and a ground end of the backlight driving circuit, where the input end of the power source of the MCU is coupled between the controllable switch and the second resistor, the monitoring device outputs the monitoring signal to a control end of the controllable switch, and a third resistor is connected in series between the monitoring device and the controllable switch. This is a specific circuit structure of the switch module, where a combination of a resistor divider and the controllable switch are used, thus simplifying circuit design, and decreasing control costs.

Furthermore, the monitoring signal comprises an enable signal controlling the conversion device to turn on or turn off, and a dimming signal adjusting a backlight brightness of the LCD, where the switch module comprises a first resistor connected to the power end of the backlight driving circuit, a second resistor connected to a ground end of the backlight driving circuit, a first controllable switch, and a second controllable switch. The first controllable switch and the second controllable switch are connected in series between the first resistor and the second resistor, and the first controllable switch and the second controllable switch are connected in parallel. The input end of the power source of the MCU is coupled between the second resistor and the connected-in-parallel first and second controllable switches, the backlight driving circuit comprises a third resistor and a fourth resistor, the monitoring device outputs the enable signal to a control end of the first controllable switch through the third resistor, the monitoring device outputs the dimming signal to a control end of the second controllable switch through the fourth resistor. Two controllable switch in parallel are used in the present disclosure, each of the controllable switches is controlled by one kind of the monitoring signals, the MCU may work as long as one monitoring signal is input to the backlight driving circuit, thus the MCU is in the power-on state when other monitoring signals are input to the backlight driving circuit, it unhappens that the monitoring signal is input the backlight driving circuit prior to the power supply, which ensures a normal working of the MCU in a condition of a plurality of the monitoring signals, and extends a applying range of the present disclosure.

Furthermore, the backlight driving circuit further comprises a peripheral circuit module, and the monitoring signal output by the monitoring device directly controls the peripheral circuit module. In the present disclosure, the monitoring signal directly controls other peripheral circuit modules except the MCU in the backlight driving circuit, thus it is no need to program the MCU, which makes changing of a typical circuit simpler, and reduces design cost.

A liquid crystal display (LCD) device comprises a backlight driving circuit of the present disclosure.

A driving method of a backlight driving circuit of the present disclosure comprises:

A: connecting a switch module between an input end of a power source of a microcontroller (MCU) and a power end of the backlight driving circuit; and B: outputting a monitoring signal by a monitoring device to turn on or turn off the switch module.

Furthermore, a step C following the step B: setting a delay time through a soft programming method, where a preset delay time is reached after the switch module turns on, and then the MCU automatically outputs a driving signal that is same as the monitoring signal output by the monitoring device, the driving signal controls a peripheral circuit module of the backlight driving circuit. As long as the MCU is in the power-on state, it means that the monitoring signal has been input to the backlight driving circuit, a method that the MCU outputs the driving signal that is same as the monitoring signal output by the monitoring device does not cause time sequence confusion. Additionally, the driving signal is generated by the MCU, the MCU firstly achieves a power supply logically, and then the driving signal which is same as the monitoring signal may be generated, thus avoiding an abnormal problem of the MCU when the monitoring signal is input to the MCU prior to the power supply, and having high reliability. The MCU may be programmed, the delay time of outputting the driving signal may be controlled through a method of the soft programming method, and the MCU is suitable for different conditions and has high generality.

In the present disclosure, the input end of the power supply of the MCU is coupled to the power end of the backlight driving circuit through the switch module, and the monitoring device outputs a monitoring signal to turn on or turn off the switch module, thus only when the monitoring signal is input to the backlight driving circuit, the switch module may turn on, and then the MCU may work in the power-on state. Thus, the MCU may be in the power-on only when the monitoring signal is input to the backlight driving circuit, in other conditions, the MUC is still able to work in no power-on state, which reduces power consumption. Additionally, the powering on of the MCU means that the monitoring signal has been input to the backlight driving circuit, and the MCU does not need to directly receive the monitoring signal, t thus avoiding abnormal problem of the MCU when the monitoring signal is input to the MCU prior to the power supply, and having high reliability.

DETAILED DESCRIPTION

Figure 1:
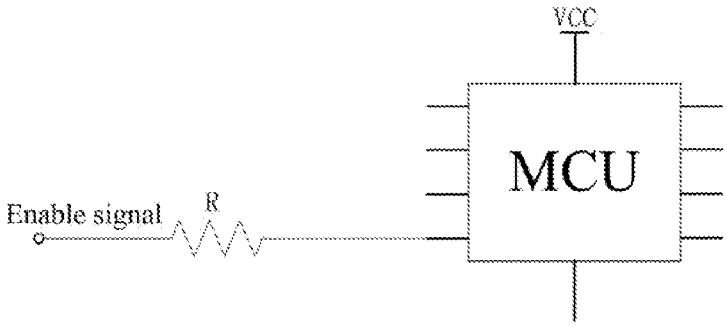
FIG. 1 (PRIOR ART)
FIG. 1 is a schematic diagram of backlight driving of a prior art.
Figure 2:
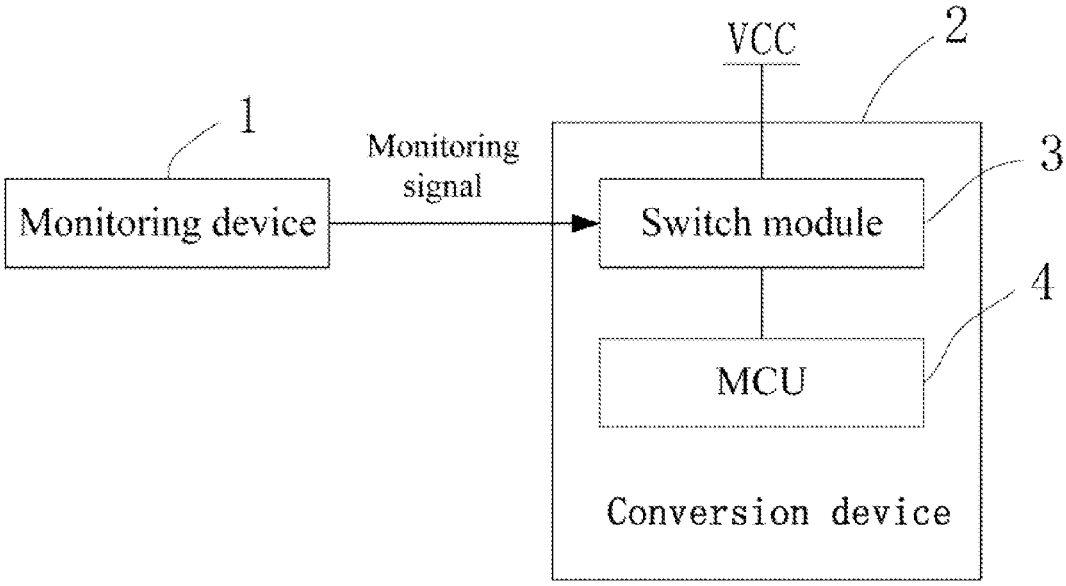
FIG. 2 is a schematic diagram of a backlight driving circuit of the present disclosure.

The present disclosure provides a liquid crystal display (LCD) device comprising a backlight driving circuit. As shown in FIG. 2, the backlight driving circuit comprises a monitoring device 1 and a conversion device 2. The conversion device 2 comprises a microcontroller (MCU) 4 and a switch module 3. A control end of the switch module 3 is coupled to the monitoring device 1, the monitoring device outputs a monitoring signal to turn on or turn off the switch module 3, and an input end of a power source of the MCU 4 is coupled to a power end (VCC) of the backlight driving circuit.

In the present disclosure, the input end of the power supply of the MCU is coupled to the power end of the backlight driving circuit through the switch module, and the monitoring device outputs the monitoring signal to turn on the switch module, thus only when the monitoring signal is input to the backlight driving circuit, the switch module may turn on, and then the MCU may work in a power-on state. So the MCU may be in the power-on state only when the monitoring signal is input to the backlight driving circuit, in other conditions, the MUC is still able to work in no power-on state, which reduces power consumption. Additionally, the powering on of the MCU means that the monitoring signal has been input to the backlight driving circuit, and the MCU does not need to directly receive the monitoring signal, thus avoiding abnormal problem of the MCU when the monitoring signal is input to the MCU prior to the power supply, and having high reliability.

The present disclosure is further described in detail in accordance with the figures and the exemplary examples.

EXAMPLE 1

Figure 3:
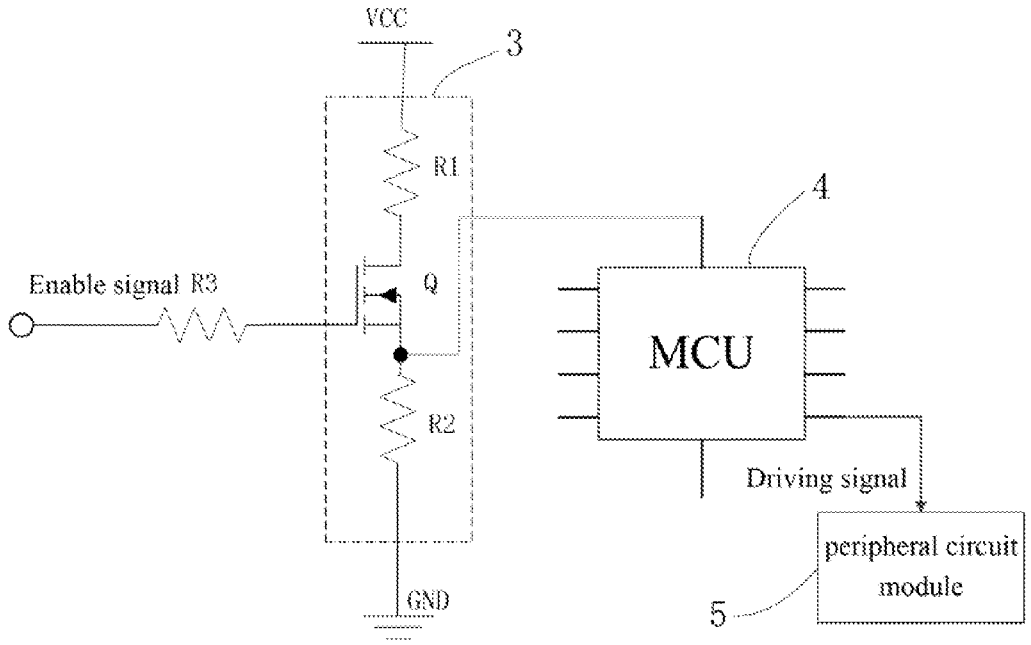
FIG. 3 is a schematic diagram of a first example of the present disclosure.

A first example provides a liquid crystal display (LCD) device comprising a backlight driving circuit. As shown in FIG. 3, the backlight driving circuit comprises a monitoring device and a conversion device, where the conversion device comprises the microcontroller (MCU) 4 and the switch module 3. The control end of the switch module 3 is coupled to the monitoring device, the monitoring device outputs the monitoring signal to turn on or turn off the switch module 3, and the input end of the power source of the MCU 4 is coupled to a power end (VCC) of the backlight driving circuit through the switch module 3. The backlight driving circuit further comprises a peripheral circuit module 5. The peripheral circuit module 5 comprises a backlight driving chip driving a display of a backlight source. When the switch module 3 turns on, the MCU 4 outputs a driving signal that is same as the monitoring signal output by the monitoring device, where the monitoring signal comprises one or more kinds of signals comprising an enable signal controlling the conversion device to turn on or turn off and a dimming signal adjusting a backlight brightness of the LCD device.

The present disclosure takes the enable signal for example in the first example. The switch module 3 comprises a first resistor R1, a controllable switch Q, and a second resistor R2 that are successively connected in series between the power end VCC and a ground end GND of the backlight driving circuit. The input end of the power source of the MCU is coupled between the controllable switch Q and the second resistor R2, and a third resistor R3 is connected in series between the monitoring device and the controllable switch Q, the monitoring device outputs the enable signal to a control end of the controllable switch Q through the third resistor R3.

The switch module is controlled by a single signal in the first example, where a combination of a resistor divider and the controllable switch are used, thus simplifying circuit design, and decreasing control costs.

In the present disclosure, the powering on of the MCU means that the monitoring signal has been input to the backlight driving circuit, thus the MCU may output the driving signal that is same as the monitoring signal output by the monitoring device, on one hand, this does not cause time sequence confusion. On the other hand, the driving signal is generated by the MCU, the MCU first is provided a power supply logically, and then the driving signal that is same as the monitoring signal may be generated, thus avoiding an abnormal problem of the MCU when the monitoring signal is input to the MCU prior to the power supply, and having high reliability. Additionally, the MCU may be programmed, where a delay time of outputting the driving signal may be controlled through a soft programming method, and the MCU is suitable for different conditions and has high generality.

It should be considered that the monitoring signal may directly control other peripheral circuit modules except the MCU in the backlight driving circuit in the present disclosure, thus it is no need to program the MCU, which makes changing of a typical circuit simpler, and reduces design costs.

EXAMPLE 2

Figure 4:
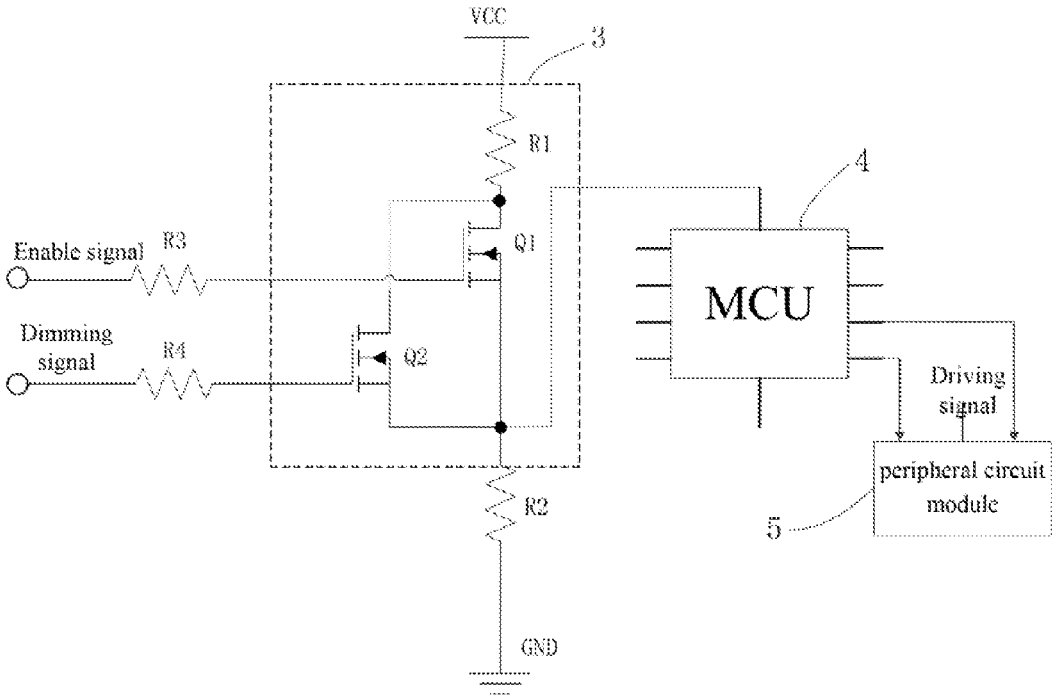
FIG. 4 is a schematic diagram of a second example of the present disclosure.

A second example provides an LCD device comprising the backlight driving circuit. As shown in FIG. 4, the backlight driving circuit comprises the monitoring device and the conversion device, where the conversion device comprises the MCU 4 and the switch module 3. The control end of the switch module 3 is coupled to the monitoring device, and the monitoring device outputs the monitoring signal to turn on or turn off the switch module 3, and the input end of the power source of the MCU 4 is coupled to the power end (VCC) of the backlight driving circuit through the switch module 3. The backlight driving circuit further comprises the peripheral circuit module 5. When the switch module 3 turns on, the MCU 4 outputs a driving signal that is same as the monitoring signal output by the monitoring device, where the monitoring signal comprises one or more kinds of signals comprising the enable signal controlling the conversion device to turn on or turn off, the dimming signal adjusting the backlight brightness of the LCD device.

The switch module 3 comprises a first resistor R1 connected to the power end VCC of the backlight driving circuit, a second resistor R2 connected to a ground end GND of the backlight driving circuit, a first controllable switch Q1, and a second controllable switch Q2. Where the first controllable switch Q1 and the second controllable switch Q2 are connected in series between the first resistor R1 and the second resistor R2, and the first controllable switch Q1 and the second controllable switch Q2 are connected in parallel. The input end of the power source of the MCU 4 is coupled between the second resistor R2, and the connected-in-parallel first controllable switch Q1 and the second controllable switch Q2. The backlight driving circuit comprises a third resistor R3 and a fourth resistor R4. The monitoring device outputs the enable signal to a control end of the first controllable switch Q1 through the third resistor R3, and the monitoring device outputs the dimming signal to a control end of the second controllable switch Q2 through the fourth resistor R4.

The present disclosure uses two controllable switch in parallel, each of the controllable switches is controlled by one kind of the monitoring signals, the MCU may work as long as one monitoring signal is input to the backlight driving circuit, thus the MCU has been in the power-on state when other monitoring signals are input to the backlight driving circuit, it unhappens that the monitoring signal is input to the backlight driving circuit prior to the power supply, which ensures a normal working of the MCU in a condition of a plurality of the monitoring signals, and extends a applying range of the present disclosure. According to the present disclosure, if there are more than three monitoring signals, a number of the controllable switches are same as a number of the monitoring signal connected in parallel may be used.

In the present disclosure, the powering on of the MCU means that the monitoring signal has been input to the backlight driving circuit, thus the MCU may output the driving signal that is same as the monitoring signal output by the monitoring device, namely the monitoring signal is the enable signal and the dimming signal in the second example. On one hand, time sequence confusion does not happen. On the other hand, the driving signal is generated by the MCU, the MCU first is provided with a power supply logically, and then the driving signal that is same as the monitoring signal may be generated, thus avoiding an abnormal problem of the MCU when the monitoring signal is input to the MCU prior to the power supply, and having high reliability. Additionally, the MCU may be programmed, where a delay time of outputting the driving signal may be controlled through the method of the soft programming method, and the MCU is suitable for different conditions and has high generality.

It should be considered that the monitoring signal may directly control other peripheral circuit modules except the MCU in the backlight driving circuit in the present disclosure, thus it is no need to program the MCU, which makes changing of a typical circuit simpler, and reduces design costs.

EXAMPLE 3

Figure 5:
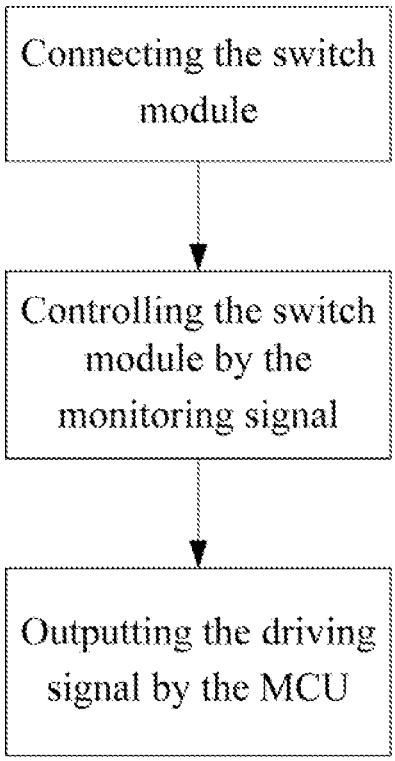
FIG. 5 is a schematic diagram of a third example of the present disclosure.

As shown in FIG. 5, a third example provides a driving method of a backlight driving circuit of the present disclosure, comprising:

A: connecting a switch module;

connecting the switch module between an input end of a power source of an MCU and a power end of the backlight driving circuit.

B: controlling the switch module by a monitoring signal;

outputting the monitoring signal by the monitoring device to turn on or turn off the switch module.

C: outputting a driving signal by the MCU.

setting a delay time through a soft programming method, where a preset delay time is reached after the switch module turns on, and then the MCU automatically outputs a driving signal that is same as the monitoring signal output by the monitoring device, the driving signal controls a peripheral circuit module of the backlight driving circuit.

In the present disclosure, the powering on of the MCU means that the monitoring signal has been input to the backlight driving circuit, thus the MCU may output the driving signal that is same as the monitoring signal output by the monitoring device. On one hand, this does not cause time sequence confusion. On the other hand, the driving signal is generated by the MCU, the MCU first is provided with a power supply logically, and then the driving signal that is same as the monitoring signal may be generated, thus avoiding an abnormal problem of the MCU when the monitoring signal is input to the MCU prior to the power supply, and having high reliability. Additionally, the MCU may be programmed, where a delay time of outputting the driving signal may be controlled through the soft programming method, and the MCU is suitable for different conditions and has high generality.

It should be considered that the monitoring signal may directly control other peripheral circuit modules except the MCU in the backlight driving circuit in the present disclosure, thus it is no need to program the MCU, which makes changing of a typical circuit simpler, and reduces design costs.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A backlight driving circuit, comprising:

a monitoring device; and a conversion device;

wherein the conversion device comprises a microcontroller (MCU) and a switch module, a control end of the switch module is coupled to the monitoring device, and the monitoring device outputs a monitoring signal to directly turn on or turn off the switch module; an input end of a power source of the MCU is coupled to a power end of the backlight driving circuit through the switch module, and the MCU is only powered on when the switch module is turned on; and the switch module comprises a first resistor connected to the power end of the backlight driving circuit, a second resistor connected to a ground end of the backlight driving circuit, a first controllable switch, and a second controllable switch; the first controllable switch and the second controllable switch are connected in series between the first resistor and the second resistor, and the first controllable switch and the second controllable switch are connected in parallel, a first conducting end of the first controllable switch is directly coupled to a first conducting end of the second controllable and a second conducting end of the first controllable switch is directly coupled to a second conducting end of the second controllable switch; the input end of the power source of the MCU is coupled between the second resistor and a connected-in-parallel first and second controllable switches.

2. The backlight driving circuit of claim 1, further comprising a peripheral circuit module, wherein the MCU outputs a driving signal that is same as the monitoring signal output by the monitoring device when the switch module turns on.

3. The backlight driving circuit of claim 1, wherein the monitoring signal comprises an enable signal controlling the conversion device to turn on or turn off.

4. The backlight driving circuit of claim 1, wherein he monitoring signal comprises a dimming signal adjusting a backlight brightness of a liquid crystal display (LCD).

5. The backlight driving circuit of claim 1, wherein the monitoring signal comprises an enable signal controlling the conversion device to turn on or turn off, and a dimming signal adjusting a backlight brightness of a liquid crystal display (LCD); the backlight driving circuit comprises a third resistor and a fourth resistor, the monitoring device outputs the enable signal to a control end of the first controllable switch through the third resistor, and the dimming signal is coupled to a control end of the second controllable switch through the fourth resistor.

6. The backlight driving circuit of claim 1, wherein the backlight driving circuit further comprises a peripheral circuit module, and the monitoring signal output by the monitoring device directly controls the peripheral circuit module.

7. A liquid crystal display (LCD) device, comprising:

a backlight driving circuit;

wherein the backlight driving circuit comprises a monitoring device and a conversion device; the conversion device comprises a microcontroller (MCU) and a switch module, a control end of the switch module is coupled to the monitoring device, and the monitoring device outputs a monitoring signal to directly turn on or turn off the switch module; an input end of a power source of the MCU is coupled to a power end of the backlight driving circuit, and the MCU is only powered on when the switch module is turned on; and the switch module comprises a first resistor connected to the power end of the backlight driving circuit, a second resistor connected to a ground end of the backlight driving circuit, a first controllable switch, and a second controllable switch; the first controllable switch and the second controllable switch are connected in series between the first resistor and the second resistor, and the first controllable switch and the second controllable switch are connected in parallel, a first conducting end of the first controllable switch is directly coupled to a first conducting end of the second controllable and a second conducting end of the first controllable switch is directly coupled to a second conducting end of the second controllable switch; the input end of the power source of the MCU is coupled between the second resistor and a connected-in-parallel first and second controllable switches.

8. The liquid crystal display (LCD) device of claim 7, wherein the MCU outputs a driving signal that is same as the monitoring signal output by the monitoring device When the switch module turns on.

9. The liquid crystal display (LCD) device of claim 7, wherein the monitoring signal comprises one or two of signals comprising an enable signal controlling the conversion device to turn on or turn off and a dimming signal adjusting a backlight brightness of the liquid crystal display (LCD).

10. The liquid crystal display (LCD) device of claim 7, wherein the monitoring signal comprises an enable signal controlling the conversion device to turn on or turn off, and a dimming signal adjusting a backlight brightness of the liquid crystal display (LCD);

wherein the backlight driving circuit comprises a third resistor and a fourth resistor, the monitoring device outputs the enable signal to a control end of the first controllable switch through the third resistor, the monitoring device outputs the dimming signal to a control end of the second controllable switch through the fourth resistor.

11. The liquid crystal display (LCD) device of claim 7, wherein the backlight driving circuit further campuses a peripheral circuit module, and the monitoring signal output by the monitoring device directly controls the peripheral circuit module.

* * * * *